US007021341B2

(12) United States Patent
Viegas et al.

(10) Patent No.: US 7,021,341 B2
(45) Date of Patent: Apr. 4, 2006

(54) FILLING STATION FOR THE FILLING OF FLUIDS

(75) Inventors: Herman H. Viegas, Minneapolis, MN (US); Osten Andersson, Köpingebro (SE); Torgeir Hansen, Finstadjordet (NO); Nils Magnus Sølverød, Oslo (NO)

(73) Assignees: Norsk Hydro ASA, Oslo (NO); Thermo King Corporation, Minneapolis, MN (US)

( * ) Notice: Subject to any disclaimer, the term of this patent is extended or adjusted under 35 U.S.C. 154(b) by 43 days.

(21) Appl. No.: 10/871,284

(22) Filed: Jun. 18, 2004

(65) Prior Publication Data

US 2004/0221918 A1 Nov. 11, 2004

Related U.S. Application Data

(63) Continuation of application No. PCT/NO02/00493, filed on Dec. 20, 2002.

(30) Foreign Application Priority Data

Dec. 21, 2001 (NO) ..... 20016354

(51) Int. Cl.
*B65B 1/04* (2006.01)

(52) U.S. Cl. ..... 141/82; 141/59

(58) Field of Classification Search ..... 141/82, 141/59, 67, 301, 302, 86; 62/50.1–50.6
See application file for complete search history.

(56) References Cited

U.S. PATENT DOCUMENTS 1,897,167 A 2/1933 Thomas
4,059,424 A 11/1977 Bentz
4,828,183 A * 5/1989 Fink, Jr. ..... 239/569
5,259,424 A 11/1993 Miller et al.
5,315,831 A 5/1994 Goode et al.
5,511,955 A 4/1996 Brown et al.
5,687,776 A * 11/1997 Forgash et al. ..... 141/11
5,730,216 A 3/1998 Viegas et al.
5,771,948 A 6/1998 Kountz et al.
5,916,246 A * 6/1999 Viegas et al. ..... 62/50.1
5,934,095 A 8/1999 Tyree, Jr.
5,954,101 A * 9/1999 Drube et al. ..... 141/82
6,044,647 A * 4/2000 Drube et al. ..... 62/50.1
6,142,191 A * 11/2000 Sutton et al. ..... 141/59
6,260,361 B1 7/2001 Tyree, Jr.
6,367,264 B1 4/2002 Tyree, Jr.

FOREIGN PATENT DOCUMENTS

EP 0941932 9/1999

OTHER PUBLICATIONS

U.S. Appl. No. 60/289,272.

* cited by examiner

*Primary Examiner*—Steven O. Douglas
(74) *Attorney, Agent, or Firm*—Michael Best and Friedrich LLP

(57) ABSTRACT

A method for distribution and sales of cryogenic fluids, in particular CO2, includes a system of filling stations for cryogenic fluids provided in connection with ordinary service stations for the filling of fuels to motor driven vehicles. The filling stations for cryogenic fluids include at least a stationary storage tank (1) and dispenser (3) with flexible hoses (4, 8) and a quick connector (5) for easy connection to a mobile tank (2) on a truck or the like. The filling station further includes a pressure/flow control column (27) with a phase separator (20) provided between the stationary storage tank (1) and the dispenser.

30 Claims, 2 Drawing Sheets

FILLING STATION FOR THE FILLING OF FLUIDS

This is a continuation of International Application No. PCT/NO02/00493, filed Dec. 20, 2002.

FIELD OF THE INVENTION

The present invention relates to a method for the distribution and sale of cryogenic fluids and a filling station for distributing or transferring fluids, in particular cryogenic refrigerants such as $CO_2$, from a storage tank to a mobile tank for instance on a vehicle. The filling station can also include piping, a dispenser with metering equipment for metering the fluid, and a filling hose with a connector for connection to the mobile tank to be filled.

BACKGROUND AND SUMMARY

Air conditioning and refrigeration systems of the type used to cool or keep frozen the loads on large trucks and trailers are conventionally based on closed vapor compression cycles.

One alternative to the closed vapor compression cycle is the use of cryogenic refrigeration systems utilizing either liquid carbon dioxide or liquid nitrogen.

In carbon dioxide-based systems, the carbon dioxide ($CO_2$) is provided in a transportable tank mounted inside the refrigeration unit or on the chassis of the truck. Inside the refrigeration unit, the $CO_2$ is vaporized in an air/$CO_2$ heat exchanger. The cooled air from this heat exchanger is blown into the storage compartment of the vehicle.

Such a system is particularly attractive because, in addition to eliminating the need for chlorofluorocarbons (CFC) or similar refrigerants which can be detrimental to stratospheric ozone, it also eliminates the needs for a refrigerant compressor and the diesel engine or other prime driving unit that drives the compressor.

An example of such a cryogenic refrigeration system that is designed for use with liquid carbon dioxide is described in U.S. Pat. No. 5,730,216.

Another prior art reference, U.S. Pat. No. 5,916,246 describes a system and method for transferring liquid carbon dioxide from a storage tank to a truck transportable tank with lower pressure. The system includes an inlet conduit having a hose portion connected between the storage and transportable tanks for conducting a flow of liquid carbon dioxide therebetween and a vent hose connected to the transportable tank for venting gaseous carbon dioxide.

One disadvantage with the system according to U.S. Pat. No. 5,916,246 for transferring liquid $CO_2$ is that the $CO_2$ loss is relatively high since gaseous carbon dioxide, created as a result of flashing when the pressure of the liquid carbon dioxide is reduced from high pressure in the storage tank to low pressure in the transportable tank, is vented off directly to the atmosphere. Further, as $CO_2$ is introduced into the transportable tank in both a liquid and a gaseous phase, the system will suffer from unwanted long filling periods and difficulties related to flow measurements.

The known filling system is designed to be placed on special truck sites, for instance at or near the garage of the truck owner or warehouse storage and requires a skilled operator to use the system. The known system further requires a skilled person to operate it as the filling operation is not fully automated.

U.S. Pat. No. 4,059,424 discloses an apparatus for the controlled supply of a cryogenic fluid such as argon or nitrogen to a point open to atmospheric air at which it is to be used. The apparatus comprises a storage tank, one phase separator and one liquid container from which liquid phase cryogenic fluid is removed. The liquid phase can be applied by means of nozzles for example in metallurgical applications or by a pouring spout to fill small containers. Depressurization and degasification of the fluid in the separator make it possible for a turbulence-free liquid phase to be obtained in the container.

The present invention is particularly well adapted for transferring a liquid cryogenic refrigerant from a storage tank to a mobile tank, where the liquid is stored in the mobile tank at a pressure above atmospheric pressure. The transfer must be carried out at a pressure well above the atmospheric pressure to reduce losses due to vaporisation of the refrigerant. Another aspect is that if liquid $CO_2$ is depressurized to atmospheric pressure, there will be a conversion of liquid $CO_2$ to $CO_2$-snow or dry ice.

U.S. Pat. No. 6,142,191 relates to an apparatus and a method for metering and transferring LNG-fuel between a storage vessel and a vehicle fuel tank. The LNG is transferred from the storage vessel to a dispenser by means of a motor driven pump. A network of conduits with motor-operated valves and liquid sensors assists in priming the pump so that a vapour-free liquid can be delivered.

This reference does not disclose a method or apparatus for transferring a cryogenic refrigerant between a storage tank and a mobile tank. Further, the apparatus does not include a separator.

U.S. Pat. No. 6,044,647 discloses a transfer system for transferring cryogenic liquid fuel (LNG) between a storage tank and a vehicle fuel tank by heating the LNG to establish a driving pressure that makes pumps or compressors superfluous. LNG is fed by gravity to the pressurizing part of the system. Downstream from this system there is arranged a separator, which allows the liquid phase to be delivered by pressure to the vehicle fuel tank.

This reference relates to combustible liquids and different applications than that of the present invention. Further, heating a refrigerant to obtain a driving pressure for its transferral is not economic as it reduces the cooling/freezing capacity of the refrigerant.

The present invention provides a system for the distribution and sale of cryogenic liquid gases, in particular carbon dioxide that is easily accessible for public use by truck drivers and other users that require quick filling of mobile cryogenic tanks or accumulators.

The system works independently of the level and pressure in the stationary storage tank. The inventive system does not require a transfer pump for transferring the liquid gas from the storage tank to the mobile tank. Therefore, the system is more reliable and maintenance costs are reduced. With the present invention, it is possible to transfer $CO_2$ to the transportable tank while at least some of the $CO_2$ is in a liquid phase, which speeds up the filling procedure.

Further, the measuring of the transferred liquid under filling is simple and reliable. The filling takes place for instance through a quick connector such as a two-port one-piece connector and no manual valves need to be operated by the operator before or after filling which makes the system easy to use. The filling system is accessible by use of a credit card and the user can thereby be invoiced through ordinary credit card systems.

The method according to the invention is characterized in a system of automated filling stations for cryogenic refrigerants, where the filling station for cryogenic refrigerants includes at least a stationary storage tank (1) and a dispenser (3) with at least one refrigerant dispensing means (4, 8) and a quick connector (5) for easy connection to a mobile tank (2) on a truck or the like as defined in the attached claims.

The filling station of the invention includes a pressure/flow control column (30) with a phase separator (20) provided between the stationary storage tank (1) and the dispenser (3), as defined in the attached claims. Preferred embodiments of the invention are also defined in the claims.

The invention will be further described with reference to the attached drawings showing a schematic representation of a system according to the invention.

DETAILED DESCRIPTION

Figure 1:
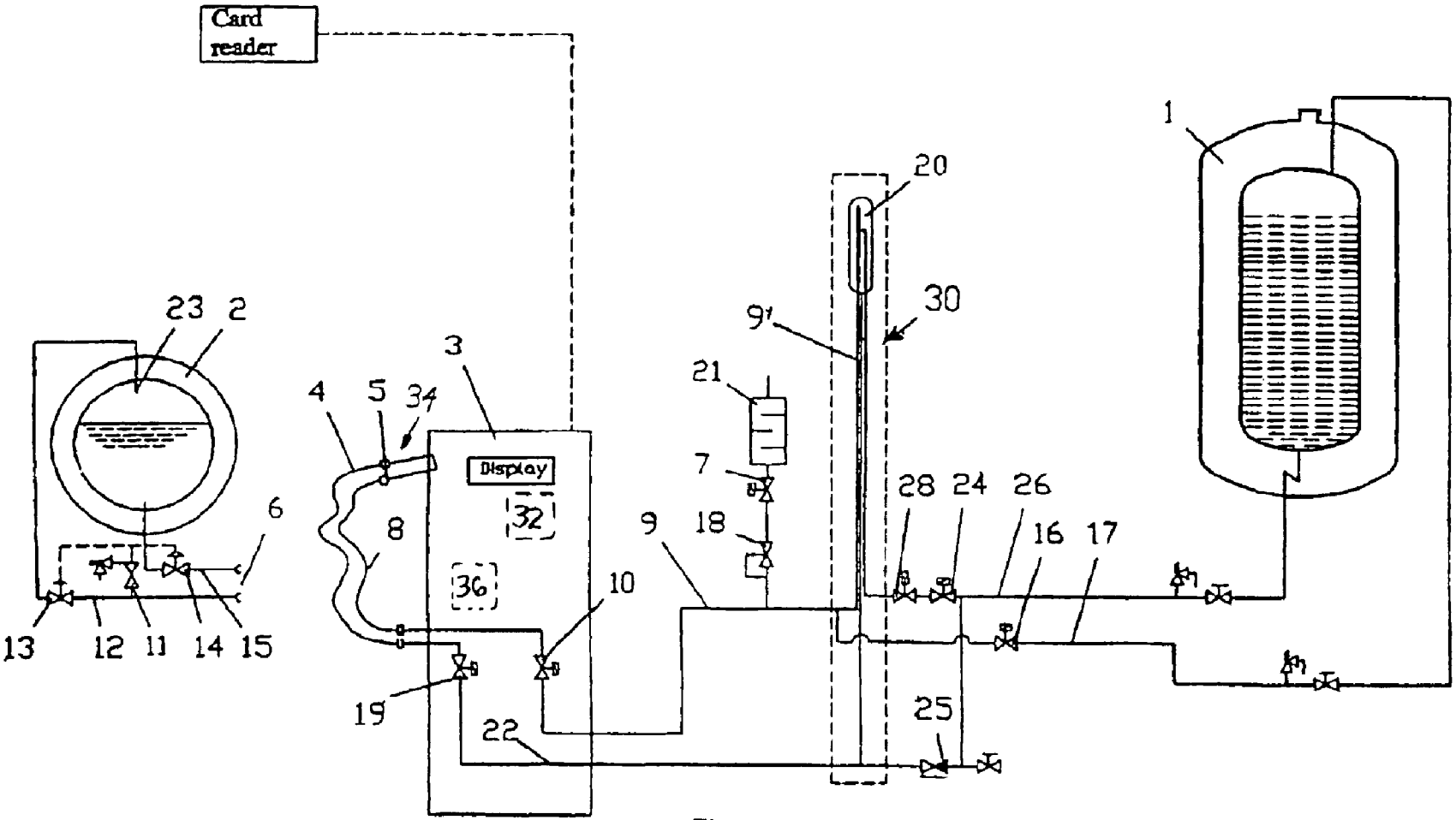
FIG. 1 shows in a first embodiment a filling station.

As shown in the drawings, the filling station of FIG. 1 includes three main components: a stationary storage tank for liquid $CO_2$, 1 a pressure/flow control column 30 (phase separator 20), and a dispenser cabinet 3. These main components are interconnected by means of liquid $CO_2$ piping 26 which extends from the storage tank 1 to the phase separator 20 with a branch pipe 22 extending to the dispenser, and a gas pipe 9 which extends from the dispenser with branch pipes 9', 17 extending to the phase separator 20 and the tank 1, respectively.

The stationary storage tank 1 is a standard insulated tank used for different $CO_2$ applications. At different filling stations, the tank size will vary from 12 to 50 $m^3$ depending on the gas turnover at the site. The storage tanks are filled from $CO_2$ trucks operated by a gas supplier.

Inside the pressure/flow control column 30 the liquid $CO_2$, during mobile tank filling is depressurized, phase separated, and measured. The pressure inside the storage tank 1 is normally higher than what is the situation in the mobile tank. Therefore, the pressure inside the column is reduced by using a back pressure regulator 18. The pressure reduction causes the liquid $CO_2$ to flash, and it produces a mixture of liquid and vapor phase inside the column 30. The two phases are separated in a phase separator 20, and the liquid phase sent to the mobile tank is measured. The vapor phase is released to the atmosphere. Alternatively, the vapor phase may be recompressed and liquefied and put back into the storage tank 1 if it is economically practical to do so.

The phase separator 20 is placed at the upper end of the pressure/flow control column 30. On top of the separator, the gas phase inside is directed through pipes and hoses connected to the gas phase of the mobile tank 2 to be filled. During filling operations, the two tanks are also connected through the liquid phase. Since the phase separator 20 is located on a higher level than the mobile tank 2, the liquids in the phase separator will, due to gravity, flow into the tank. Gravity is the only driving force used to fill the mobile tank. This effect also guarantees sub cooled liquid $CO_2$ at the bottom of the pressure/flow control column 30. This provides ideal conditions for flow measurements without using a density meter.

Inside the dispenser cabinet 3, a flow measurement processor (not shown in the drawing) is provided. This unit reads the signals from different transmitters in the measurement system (not shown) and calculates the actual flow delivered from the dispenser. The flow is presented on a display mounted on the dispenser cabinet 3. The processor also works as a programmable logic controller (PLC) that operates the different valves in the system during filling and communicates with the credit card reader system 32.

The dispenser cabinet 3 is also equipped with hoses 4, 8 and couplings respectively for evacuation of excess gas if necessary and filling of liquid gas to the mobile tank. The coupling for connection of the hoses 4, 8 to the mobile tank is preferably but not necessary in the form of a two-port quick connector 5 (not shown in detail) that connects both the liquid 8 and gas hose 4 in one operation. The quick connector has shut off valves that close when uncoupled. It can be coupled and uncoupled even when pressurized. Alternatively, the coupling may consist of separated hose connections.

The shut off valves associated with the mobile tank can be operated by gas pressure from the dispenser. The valves therefore open automatically when the quick connector is connected. The operator does not have to operate any valves during filling. The filling hoses are equipped with breakaway couplings 34 to avoid major gas leakage if the vehicle with the mobile tank should be moved before the hoses are disconnected.

Working principle in detail:

The sequence for mobile tank filling starts when the truck driver uses a credit card in the card reader (not shown in the drawing). The filling station is then released for filling.

The operator can then connect the filling hoses 4 and 8 by disconnecting the quick connector 5 (not shown in further detail) from the resting position on the dispenser 3 and fitting it to the corresponding (male) connector 6 associated with the mobile tank (not shown). Immediately after the connector has been moved from its resting position, valve 7 opens and gas being present in the gas evacuation hose 8 and connected piping 9 corresponding to pressure above 8 bars is released to the atmosphere. The pressure in the gas hose 8 will then be approximately 8 bars when it is connected to the truck as valve 10 on the piping 9 also functions as a check valve.

As the connection is accomplished, gas at a pressure provided in the gas hose will pass through a valve 11 on the gas evacuation piping 12 on the mobile tank and pressurize the actuators of valves 14 and 13 provided on the liquid gas filling piping 15 and gas evacuation piping 12, respectively. Both valves will open. If the pressure now stabilizes at 6 to 8 bars, the system is ready to start filling. If the pressure drops, the mobile tank 2 must have been unpressurized, and needs to be filled with gas phase. It should be understood that the pressure can be detected for instance by means of sensors (not shown). The filling of gas phase into the tank is automatically accomplished by opening of valve 10 on the piping 9 and valve 16 on the piping 17 on the stationary filling station such that gas is transferred from the gas phase of the stationary tank 1 to the mobile tank 2 until sufficient pressure is reached.

Alternatively, the valves 14 and 13 can be arranged in such a manner that the filling connector activates the valves when it is connected with connector 6 associated with the mobile tank 2. This action can be performed by mechanical means or the equivalent known by those skilled in the art that manipulate the valves as the connectors are brought together.

The operator must now press a "Start" button on the dispenser cabinet 3 if provided. Alternatively, the system can be adapted for automatic start of filling when sufficient pressure is reached or by other appropriate initial conditions being achieved. Valves 10, 19 and 24 are then opened. Liquid gas is then fed from the stationary storage tank 1 into the phase separator 20. Gaseous $CO_2$ is led from the separator 20 to the atmosphere through a muffler 21 via a back pressure regulator 18 and the valve 7. Liquid gas fills the pressure/flow control column 30 and is transported via liquid filling piping 22, the hose 8 and mobile filling piping 15 into the mobile tank 2. The measurement system provided in the dispenser cabinet (not shown) starts reading. The gas phase in the mobile tank 2 that is displaced due to the filling of the liquid gas flows through the gas evacuation hose 4 and is discharged to the atmosphere through the muffler 21 via the piping 9 and valves 18 and 7.

This process will continue until the mobile tank is full. The tank is full when the liquid level in the tank exceeds the position of the end 23 of the gas evacuation pipe 12. The return gas from the tank will then contain liquid droplets which are detected by an overfill sensor 36 in the cabinet 3. The sensor provides signals to valves 7, 10, 19 and 24 to close the valves and filling is then stopped. The flow measurement reading then also automatically stops, and a signal is sent to the display of the cabinet 3 informing the card reader of the quantity of gas transferred to the mobile tank 2.

The operator will then disconnect the (female) filling connector 5 on the hoses 4, 8 from the truck and fit it into its resting position on the dispenser cabinet 3. The valves 13 and 14 will then close within a few seconds. This happens because the gas operating the actuators will leak out from the system through a small hole (not shown) for instance drilled in a non-return sleeve in the connector 6 (not shown).

The hoses 4, 8 and the pipes 9 in the fill station are now partially filled with liquid $CO_2$. This liquid will evaporate and cause the pressure in the system to rise. When the pressure exceeds the storage tank pressure, the remaining liquid will be forced back to the tank through a check valve 25 provided on the liquid filling pipe 22. This valve is located at the lowermost level in the piping system to make as much liquid as possible return to storage tank. Valves 10 and 19 are also functioning as check valves such that liquid will be drained from the hoses 4, 8. When the system is drained, the pressure in the pipes will be slightly higher than in the storage tank.

The system will be ready to start a new filling immediately after the former filling has been completed. It is not necessary to complete the draining of liquid to get ready for a new start.

It should be understood that the hoses 4 and 8 may be integrated into one flexible line, comprising twin hoses or coaxially arranged hoses.

Further, in one embodiment a boost pump can be arranged in line 22 to speed up the filling procedure.

Figure 2:
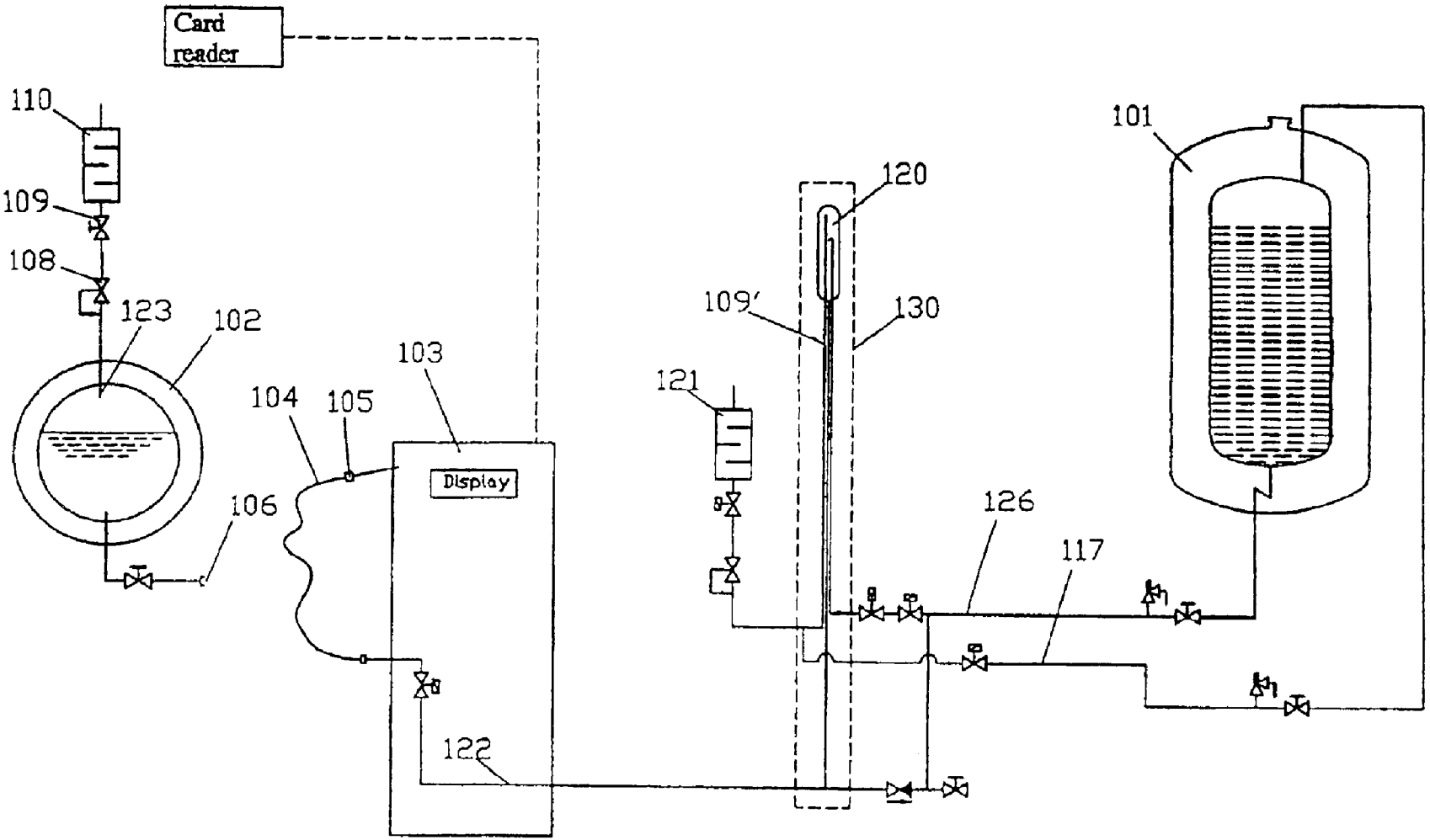
FIG. 2 shows in a second embodiment a filling station.

FIG. 2 shows another embodiment of a filling station. As in the previous example, the filling station includes three main components: a stationary storage tank for liquid $CO_2$, 101 a pressure/flow control column 130 (phase separator 120), and a dispenser cabinet 103. These main components are interconnected by liquid gas piping 126 extending from the storage tank 101 to the phase separator 120 with a branch pipe 122 extending to the dispenser. The gas phase circuit comprises a branch pipe 109' extending to a separator 120, being connected with branch 117 to the storage tank 101 and one branch preferably comprising a muffler 121. The stationary system may further comprise valves and control regulators, card reader etc. similar to those described in the previous embodiment.

The main difference between this embodiment and the previous one is that here is applied only one liquid filling hose, i.e. there is not arranged any return hose for any gaseous phase from the mobile tank. During filling operations of the mobile tank, mainly liquid phase cryogen enters the tank through fluid dispensing means 105 that can be a flexible hose. At the end of the fluid dispensing means there is arranged a connector 105 that matches connector 106 associated with the mobile tank 102. The filling operation can be started as soon as the connectors are brought together and the terms of payment are accepted. As soon as liquid cryogen starts to enter the mobile tank 102, any gas flashed off can be evacuated through a muffler 110 controlled by check valves 108, 109 of appropriate settings. These check valves shall ensure that on the one hand there is maintained a certain counter pressure in the filling operation and on the other hand the pressure inside the tank will not exceed a certain level for security reasons. Inside the tank, there may be arranged a level detecting system 123, such as a capacitor or droplet-based system, to detect when the maximum filling level has been reached. The filling can then be stopped either by producing an audio-signal warning or by any sort of communication between the detecting system 123 and the CPU controlling the system. The filling operation may be interrupted by sensing the counter pressure in the mobile tank as well, in a manner similar to existing systems for fuel tanking.

What is claimed is:

1. A cryogen dispensing system for filling a mobile cryogen tank, the dispensing system comprising:

a storage tank housing liquid cryogen and cryogen vapor;

a liquid duct system fluidly connected to the storage tank and being connectable to the mobile cryogen tank for transferring the liquid cryogen from the storage tank to the mobile cryogen tank; and a vapor duct system fluidly connected to the storage tank and being connectable to the mobile cryogen tank for transferring the cryogen vapor from the storage tank to the mobile cryogen tank to pressurize the mobile cryogen tank.

2. The cryogen dispensing system of claim 1, further comprising a nozzle fluidly connectable to the mobile cryogen tank, wherein at least a portion of the liquid duct system extends through the nozzle, and wherein at least a portion of the vapor duct system extends through the nozzle.

3. The cryogen dispensing system of claim 2, wherein the nozzle includes a break-away coupling.

4. The cryogen dispensing system of claim 1, further comprising a pay station supported on the dispensing system, the pay station being operable to receive a payment and being operable to control flow of the liquid cryogen from the storage tank to the mobile cryogen tank following receipt of the payment.

5. The cryogenic dispensing system of claim 1, wherein gravity moves the liquid cryogen from the storage tank to the mobile cryogen tank.

6. The cryogen dispensing system of claim 1, further comprising a phase separator for receiving the liquid cryogen from the storage tank and being operable to reduce pressure of the liquid cryogen before the liquid cryogen is directed toward the mobile cryogen tank.

7. The cryogen dispensing system of claim 1, further comprising an upwardly extending column, and wherein at least a portion of the vapor duct system extends through the upwardly extending column.

8. The cryogen dispensing system of claim 7, wherein at least a portion of the liquid duct system extends through the upwardly extending column.

9. The cryogen dispensing system of claim 7, wherein at least a portion of the upwardly extending column is elevated above the storage tank.

10. The cryogen dispensing system of claim 1, further comprising a back-pressure regulating valve for controlling pressure in the cryogen dispensing system.

11. The cryogen dispensing system of claim 1, further comprising a sensor positioned along the vapor duct system for sensing a quantity of liquid cryogen in the vapor duct system.

12. A method of transferring cryogen from a filling station to a mobile tank having a pressure sensor, the filling station including a storage tank housing a quantity of cryogen, the method comprising the acts of:

providing a set point pressure;

sensing pressure in the mobile tank with the pressure sensor;

comparing the pressure in the mobile tank to the set point pressure;

transferring cryogen vapor from the storage tank to the mobile tank when the pressure in the mobile tank is below the set point pressure; and transferring liquid cryogen from the storage tank to the mobile tank when the pressure in the mobile tank is above the set point pressure.

13. The method of claim 12, further comprising the acts of providing a liquid duct system fluidly connected to the storage tank;

connecting the liquid duct system to the mobile cryogen tank;

providing a vapor duct system fluidly connected to the storage tank; and connecting the vapor duct system to the mobile cryogen tank;

wherein the act of transferring the liquid cryogen from the storage tank to the mobile tank includes the act of transferring the liquid cryogen through the liquid duct system;

wherein the act of transferring the cryogen vapor from the storage tank to the mobile tank includes the act of transferring the cryogen vapor through the vapor duct system.

14. The method of claim 12, wherein the filling system includes a nozzle fluidly connectable with the mobile cryogen tank, wherein the act of transferring the liquid cryogen from the storage tank to the mobile tank includes the act of directing the cryogen vapor through the nozzle toward the mobile tank, and wherein the act of transferring the cryogen vapor from the storage tank to the mobile tank includes the act of directing the liquid cryogen from the storage tank through the nozzle toward the mobile tank.

15. The method of claim 12, wherein the filling station includes a pay station, and further comprising the act of operating the pay station to transfer a payment.

16. The method of claim 12, wherein gravity moves at least some of the liquid cryogen from the storage tank to the mobile tank.

17. The method of claim 12, wherein the filling station includes a phase separator, and further comprising the act of reducing pressure of the liquid cryogen in the phase separator before the liquid cryogen is transferred from the storage tank to the mobile tank.

18. The method of claim 12, wherein the filling station includes an upwardly extending column, and wherein the act of transferring the liquid cryogen from the storage tank to the mobile tank includes directing the liquid cryogen from the storage tank through the upwardly extending column.

19. The method of claim 12, wherein the filling station includes a vapor duct system fluidly connected to the storage tank and a sensor positioned along the vapor duct system, wherein the act of transferring the cryogen vapor from the storage tank to the mobile tank when the pressure in the mobile tank is below the set point pressure includes the act of transferring the cryogen vapor through the vapor duct system, and further comprising the acts of connecting the vapor duct system to the mobile cryogen tank; and interrupting the flow of the liquid cryogen to the mobile tank when the sensor senses liquid cryogen in the vapor duct system.

20. A cryogen dispensing system for filling a mobile cryogen tank, the dispensing system comprising:

a storage tank housing cryogen;

a liquid duct system fluidly connected to the storage tank and being connectable to the mobile cryogen tank for transferring the cryogen from the storage tank to the mobile cryogen tank;

a vapor duct system fluidly connected to the storage tank and being connectable to the mobile cryogen tank to pressurize the mobile cryogen tank; and a sensor positioned along the vapor duct system for sensing liquid cryogen in the vapor duct system.

21. The cryogen dispensing system of claim 20, wherein the storage tank houses cryogen vapor, and wherein the vapor duct system is operable to transfer at least some of the cryogen vapor from the storage tank to the mobile cryogen tank.

22. The cryogen dispensing system of claim 20, further comprising a nozzle fluidly connectable with the mobile tank, wherein at least a portion of the liquid duct system extends through the nozzle, and wherein at least a portion of the vapor duct system extends through the nozzle.

23. The cryogen dispensing system of claim 22, wherein the nozzle includes a break-away coupling.

24. The cryogen dispensing system of claim 20, further comprising a pay station supported on the dispensing system, the pay station being operable to receive a payment and being operable to control transfer of the cryogen from the storage tank to the mobile cryogen tank following receipt of the payment.

25. The cryogenic dispensing system of claim 20, wherein gravity moves the cryogen from the storage tank to the mobile cryogen tank.

26. The cryogen dispensing system of claim 20, further comprising a phase separator for receiving the cryogen from the storage tank and being operable to reduce pressure of the cryogen before the cryogen is directed through the liquid duct system toward the mobile cryogen tank.

27. The cryogen dispensing system of claim 20, further comprising an upwardly extending column, and wherein at least a portion of the liquid duct system extends through the upwardly extending column.

28. The cryogen dispensing system of claim 27, wherein at least a portion of the vapor duct system extends through the upwardly extending column.

29. The cryogen dispensing system of claim 27, wherein at least a portion of the upwardly extending column is elevated above the storage tank.

30. The cryogen dispensing system of claim 20, further comprising a back-pressure regulating valve for controlling pressure in the cryogen dispensing system.

* * * * *